US008330701B2

(12) United States Patent
Kim et al.

(10) Patent No.: US 8,330,701 B2
(45) Date of Patent: Dec. 11, 2012

(54) DEVICE AND METHOD FOR DRIVING LIQUID CRYSTAL DISPLAY DEVICE

(75) Inventors: Beon-Young Kim, Gyeongbuk (KR); Sang-Hoon Lee, Daegu (KR)

(73) Assignee: LG Display Co., Ltd., Seoul (KR)

( * ) Notice: Subject to any disclaimer, the term of this patent is extended or adjusted under 35 U.S.C. 154(b) by 407 days.

(21) Appl. No.: 12/638,893

(22) Filed: Dec. 15, 2009

(65) Prior Publication Data

US 2010/0214316 A1 Aug. 26, 2010

(30) Foreign Application Priority Data

Feb. 20, 2009 (KR) ..... 10-2009-0014328

(51) Int. Cl.
*G09G 3/36* (2006.01)

(52) U.S. Cl. ..... 345/100

(58) Field of Classification Search ..... 345/100, 345/101, 98
See application file for complete search history.

(56) References Cited

U.S. PATENT DOCUMENTS

| | | | | |
|---|---|---|---|---|
| 5,717,421 | A * | 2/1998 | Katakura et al. | 345/101 |
| 6,160,534 | A * | 12/2000 | Katakura | 345/98 |
| 7,691,432 | B2 * | 4/2010 | Jung et al. | 427/58 |
| 8,115,506 | B2 * | 2/2012 | Brunner | 324/760.01 |
| 2004/0090413 | A1 * | 5/2004 | Yoo | 345/100 |
| 2009/0177930 | A1 * | 7/2009 | Park | 714/49 |
| 2009/0195493 | A1 * | 8/2009 | Fujiyoshi | 345/100 |

* cited by examiner

*Primary Examiner* — Fred Tzeng
(74) *Attorney, Agent, or Firm* — Birch, Stewart, Kolasch & Birch, LLP

(57) ABSTRACT

The present invention relates to device and method for driving a liquid crystal display device. The device includes a liquid crystal display panel having a plurality of pixel regions, a gate driver for driving a plurality of gate lines on the liquid crystal display panel, a data driver for driving a plurality of data lines on the liquid crystal display panel, and a timing controller for analyzing an image data received from an outside of the driver according to pattern recognition information having a detection factor and a detection stop factor for a defective display pattern to detect, or stopping detection of, the defective display pattern, and changing an inversion system of the liquid crystal display panel according to a result of the detection of the defective display pattern.

10 Claims, 4 Drawing Sheets

DEVICE AND METHOD FOR DRIVING LIQUID CRYSTAL DISPLAY DEVICE

CROSS REFERENCE TO RELATED APPLICATION

This application claims the benefit of Korean Patent Application No. 10-2009-0014328, filed on Feb. 20, 2009, which is hereby incorporated by reference as if fully set forth herein.

BACKGROUND OF THE DISCLOSURE

1. Field of the Disclosure

The present invention relates to liquid crystal display devices, and more particularly, to device and method for driving a liquid crystal display device, in which a detection factor for a defective display pattern, and a detection stop factor for the defective display pattern are changeably set for preventing defective display and a poor picture quality caused by frequent pattern change from taking place.

2. Discussion of the Related Art

Recently, as flat panel display devices for use in personal computers, personal digital assistants, and monitors for various information apparatuses, the liquid crystal display devices, light emitting display devices, plasma display panels, field emission display devices, and so on are under development.

Of above flat panel display devices, the liquid crystal display devices are used widely owing to low power driving, and a good picture quality. The liquid crystal display device displays a picture by controlling a light transmissivity of liquid crystals by using an electric field. For this, the liquid crystal display device is provided with a liquid crystal display panel having a plurality of pixel cells, a backlight unit for directing a light to the liquid crystal display panel, and a driving circuit for driving the pixel cells. For driving sub-pixels on the liquid crystal display panel in the liquid crystal display device, inversion driving systems, such as a frame inversion system, a line inversion system, dot inversion system, and so on are used. Of the inversion driving systems, the dot inversion system provides a picture of a picture quality better than the frame and line inversion systems.

However, even if an image is displayed by the dot inversion system, in a case an image of a particular pattern, for an example, a vertical line pattern of a gray background, or a horizontal line pattern having a high contrast, is displayed, the picture quality is poor due to distortion of a common voltage, causing smear on a display screen or the like.

Consequently, in the related art, devices and methods are studied, in which predefined defective display patterns which cause smear are detected at the time of a video data input, and the inversion system is changed if the smear causing pattern is detected. A method for detecting the smear causing pattern developed the most in the related art is a method for setting defective display pattern information for detecting the smear causing pattern, and comparing the defective display pattern information set thus to an image data.

However, the related art method for detecting a defective display pattern, for an example, the smear causing pattern, develops defective picture display due to frequent change of the inversion system in a case changes of brightness of the picture and pattern are great. In other words, in the related art, the defective display, such as flickering of the screen before or after a threshold value caused by frequent change of a preset pattern inclusion ratio, for an example, a pattern perception (on/off) of picture pattern change coming from movement of a folder window, movement of a mouse, and so on, becomes more serious.

SUMMARY OF THE DISCLOSURE

Accordingly, the present invention is directed to device and method for driving a liquid crystal display device.

An object of the present invention is to provide device and method for driving a liquid crystal display device, in which a detection factor for defective display patterns, and a detection stop factor for the defective display patterns are changeably set for preventing defective display and a poor picture quality caused by frequent pattern change from taking place.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a device for driving a liquid crystal display device includes a liquid crystal display panel having a plurality of pixel regions, a gate driver for driving a plurality of gate lines on the liquid crystal display panel, a data driver for driving a plurality of data lines on the liquid crystal display panel, and a timing controller for analyzing an image data received from an outside of the driver according to pattern recognition information having a detection factor and a detection stop factor for a defective display pattern to detect, or stopping detection of, the defective display pattern, and changing an inversion system of the liquid crystal display panel according to a result of the detection of the defective display pattern.

The pattern recognition information includes the detection factor and detection stop factor for the defective display pattern, an enable signal and disable signal, wherein the enable signal is a signal for making the timing controller to perform a defective display pattern recognition operation, and the disable signal is a signal for making the timing controller to stop the defective display pattern recognition operation, the defective display pattern detection factor is a value for representing a ratio of identity of at least one frame of the image data to a preset defective display pattern, and the defective display pattern detection stop factor is a value for representing a ratio of identity of the at least one frame of the image data to the preset defective display pattern, set at a value lower than the detection factor.

The timing controller includes an image processing unit for arranging the image data suitable for driving the liquid crystal display panel, supplying the image data to the data driver, and analyzing the image data with reference to the pattern recognition information to detect defective display pattern or stop detection of the defective display pattern, a gate control signal generating unit for generating the gate control signal by using at least one of the synchronizing signals received from an outside of the driving device, and supplying the gate control signal to the gate driver, and a data control signal generating unit for generating the data control signal by using at least one of the synchronizing signals, and changing and forwarding the horizontal and vertical POL signals of the data control signal according to a result of the detection of the defective display pattern.

The image processing unit includes a data arranging unit for arranging, and forwarding the image data suitable to a resolution and a screen size to be displayed on the liquid crystal display panel, and a pattern recognition unit for analyzing the image data to detect the defective display pattern, or stop the detection of the defective display pattern with reference to the pattern recognition information, and forwarding a first or second selection signal according to a result of the detection.

In another aspect of the present invention, a method for driving a liquid crystal display device includes the steps of setting pattern recognition information having a defection factor and a detection stop factor of a defective display pattern at a timing controller, analyzing an image data receiving from an outside with reference to the pattern recognition information for detecting the defective display pattern, or stopping the detection, and changing or maintaining an inversion system of the liquid crystal display panel depending on a result of detection of the defective display pattern by using the pattern recognition information.

The pattern recognition information includes the detection factor for the defective display pattern, the detection stop factor, an enable signal, and an disable signal, the enable signal is a signal for making the timing control to perform a defective display pattern recognition operation, and the disable signal is a signal for making the timing control to stop the defective display pattern recognition operation, the defective display pattern detection factor is a value representing an identity ratio of at least one frame of the image data to the preset defective display pattern, and though the detection stop factor is a value representing an identity ratio of at least one frame of the image data to the preset defective display pattern, the detection stop factor is set at a value lower than the detection factor.

The step of analyzing an image data includes the steps of arranging the image data suitable to a resolution and a screen size of the liquid crystal display panel, and supplying the image data arranged thus to a data driver, and comparing the image data arranged thus to the defective display pattern in at least frame by frame upon reception of the enable signal, and stopping the comparison of the image data arranged thus to the defective display pattern upon reception of the disable signal.

The step of changing or maintaining an inversion system of the liquid crystal display panel includes the steps of comparing a result of the comparison of the defective display pattern to the image data arranged thus to the detection factor of the defective display pattern or the detection stop factor, and forwarding the first or second selection signal depending on a result of the comparison, and changing a POL signal of the data control signal in correspondence to the first or second selection signal, and supplying the POL signal changed thus to the data driver.

The step of forwarding the first or second selection signal includes the steps of generating and forwarding the first selection control signal for changing the inversion system, if the identity ratio of at least one frame of image data to the preset defective display pattern is greater than the defective display pattern detection factor as a result of the comparison of the image data arranged thus to the preset defective display pattern, and generating and forwarding the second selection control signal for changing the inversion system, if the identity ratio of at least one frame of image data to the preset defective display pattern is smaller than the defective display pattern detection stop factor as a result of the comparison of the image data arranged thus to the preset defective display pattern.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DESCRIPTION OF SPECIFIC EMBODIMENTS

Reference will now be made in detail to the specific embodiments of the present invention, examples of which are illustrated in the accompanying drawings. Wherever possible, the same reference numbers will be used throughout the drawings to refer to the same or like parts.

Figure 1:
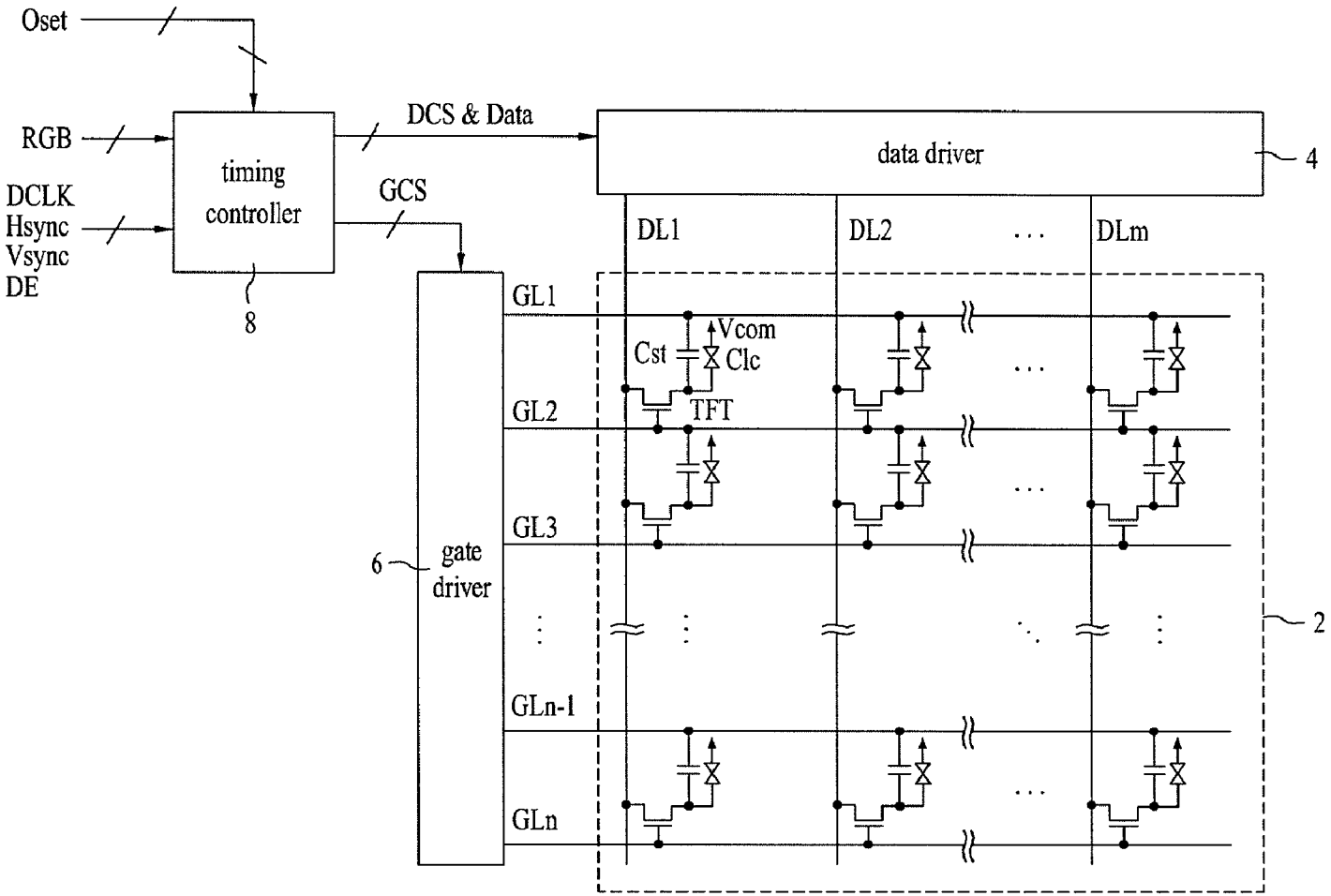
FIG. 1 illustrates a block diagram of a device for driving a liquid crystal display device in accordance with a preferred embodiment of the present invention.

FIG. 1 illustrates a block diagram of a device for driving a liquid crystal display device in accordance with a preferred embodiment of the present invention.

Referring to FIG. 1, the driver for a liquid crystal display device includes a liquid crystal display panel 2 having a plurality of pixel regions, a data driver 4 for driving a plurality of data lines DL1~DLm, a gate driver 6 for driving a plurality of gate lines GL1~GLn, and a timing controller 8 for analyzing an image data RGB received from an outside of the driver according to pattern recognition information 0*set* having a detection factor and a detection stop factor for a defective display pattern to detect, or stopping detection of, the defective display pattern, and changing an inversion driving system of the liquid crystal display panel according to a result of the detection of the defective display pattern.

The timing controller 8 receives and arranges the image data R, G, B suitable for driving the liquid crystal display panel and supplies the image data R, G, B to the data driver 4, and generates gate and data control signals GCS, and DCS by using synchronizing signals DCLK, Hsync, Vsync, DE received from an outside, for an example, an outside system, and supplies the gate and data control signals GCS, and DCS generated thus to the gate and data drivers 6 and 4, respectively.

The liquid crystal display panel 2 has thin film transistors FTF formed at pixel regions defined by a plurality of gate lines GL1~GLn and a plurality of data lines DL1~DLm, and liquid crystal capacitors C1*c* connected to the thin film transistors TFT, respectively. The liquid crystal capacitor C1*c* has a pixel electrode connected to the thin film transistor TFT, and a common electrode facing the pixel electrode with the liquid crystals disposed therebetween. The thin film transistor TFT supplies the image signal from the data lines DL1~DLm to the pixel electrode in response to a scan pulse from the gate lines GL1~GLn. The liquid crystal capacitor C1*c* has a voltage charged therein, which is a difference between the image signal supplied to the pixel electrode and a reference common voltage supplied to the common electrode, and varies an orientation of liquid crystal molecules with the difference of the voltage to control a light transitivity for producing a gray scale. The liquid crystal capacitor C1*c* has a storage capacitor Cst connected thereto in parallel for making the voltage charged at the liquid crystal capacitor C1*c* to be sustained until the next data signal is supplied thereto. The storage capacitor Cst is formed overlapped with the pixel electrode with a prior gate line and an insulation film disposed therebetween or with a storage line and the insulation film disposed therebetween.

The data driver 4 converts the image data from the timing controller 8 arranged thus into an analog voltage, i.e., an image signal by using data control signals DCS, for an example, a source start pulse SSP, a source shift clock SSC, a source output enable signal SOE and so on from the timing controller. Along with this, the data driver 4 changes or maintains the inversion driving system for the liquid crystal display panel 2 in response to vertical and horizontal POL signals which are polarity control signals among the data control signals.

In detail, the data driver 4 latches the image data arranged at the timing controller 8 in response to the SSC, and supplies a image signal of one horizontal line portion to the data lines DL1~DLm in every one horizontal period in which the scan pulse is supplied to the gate lines GL1~GLn in response to the SOE signal. In this instance, the data driver 4 selects a positive or negative polarity gamma voltage of a predetermined level according to the gray scale of the image data Data arranged to correspond to the POL signal, and supplies the gamma voltage selected thus to the data lines DL1~DLm as the image signal.

The vertical and horizontal POL signals are signals for changing the liquid crystal display panel to be driven in a first or second inversion system from the timing controller 8. In other words, the liquid crystal display panel 2 is driven in the first or second inversion system in response to the vertical and horizontal POL signals changed at and received from the timing controller 8, wherein the first inversion system can be at least one of 1×1, 2×1, 1×2, 2×2, and 3×3 dot inversion systems, and the second inversion system can be one of 2×2, 3×3, 4×4, and 5×5 dot inversion systems, and vertical/horizontal line inversion systems, which is different from the first inversion system.

The gate driver 6 generates scan pulses in succession in response to gate control signals GCS from the timing controller 8, for an example, a gate start pulse GSP, a gate shift clock GSC, and a gate output enable signal GOE, and supplies the scan pulses to the gate lines GL1~GLn in succession. In other words, the gate driver 6 shifts the GSP from the timing controller 8 according to the GSC, and supplies the scan pulses, for an example, gate on voltages to the gate lines GL1~GLn in succession. In a period when no gate on voltage is supplied to the gate lines GL1~GLn, the gate driver 6 supplies gate off voltages. In this instance, the gate driver 6 controls a pulse width of the scan pulse in response to the GOE signal.

The timing controller 8 arranges the image data R, G, B from an outside of the driving device suitable for driving the liquid crystal display panel 2, i.e., a size and resolution of the liquid crystal display panel 2, and supplies to the data driver 30. In this instance, the timing controller 8 analyzes the image data R, G, B received from an outside of the driving device with reference to pattern recognition information 0*set* preset by a designer. That is, the timing controller 8 detects the defective display pattern or stops the detection of the defective display pattern from the image data received from the outside of the driving device in response to the preset pattern recognition information 0*set*. Then, the timing controller 8 changes the inversion driving system for the liquid crystal display panel 2 according to a result of detection of the defective display pattern.

The pattern recognition information 0*set* is a value preset by a designer in a production process of the product, or input by a user selectively, and includes a defective display pattern detection factor, a defective display pattern stop factor, and a pattern recognition enable signal and a disenable signal. The defective display pattern detection factor, and the defective display pattern stop factor are values the designer presets and stores, and the pattern recognition enable signal and disenable signal may be preset by the designer or input by the user selectively.

In detail, the pattern recognition enable signal and disenable signal are signals different from each other, which can be represented with at least one bit signal, for an example, "0" or "1", respectively. Though the enable signal enables the timing controller 8 to perform the defective display pattern recognition operation, the disenable signal makes the timing controller 8 to stop the defective display pattern recognition operation. In the defective display pattern recognition operation is stopped by the disenable signal, the liquid crystal display panel 2 may be driven by a preset inversion system, for an example, the first inversion system.

The defective display pattern detection factor is a an identity ratio of a preset defective display pattern to at least one frame of the image data. That is, the detection factor represents a ratio (for an example, 30%~60%), a ratio of identity of the defective display pattern in comparison to at least one frame portion of the image data.

The detection stop factor is also a ratio of identity of the defective display pattern in comparison to the at least one frame portion of the image data. However, it is preferable that the detection stop factor is set at a lower value, i.e., a lower ratio, than the detection factor, for minimizing an influence from frequent brightness change of the screen.

The detection factor and the detection stop factor are used as reference values for changing the inversion system, for an example, if the detection ratio of the defective display pattern is higher than the detection factor, the liquid crystal display panel 2 is made to be driven by the first inversion system, and if the detection ratio of the defective display pattern is lower than the detection stop factor, the liquid crystal display panel 2 is made to be driven by the second inversion system.

In the meantime, the timing controller 8 generates the gate control signal GCS and the data control signal DCS by using the synchronizing signals DCLK, DE, Hsync, and Vsync received from the outside of the driving device, and supplies the gate control signal GCS and the data control signal DCS generated thus to the gate driver 6 and the data driver 4 respectively, for controlling the gate driver 6 and the data driver 4. System and operation of the timing controller 8 will be described in more detail, with reference to the attached drawings.

Figure 2:
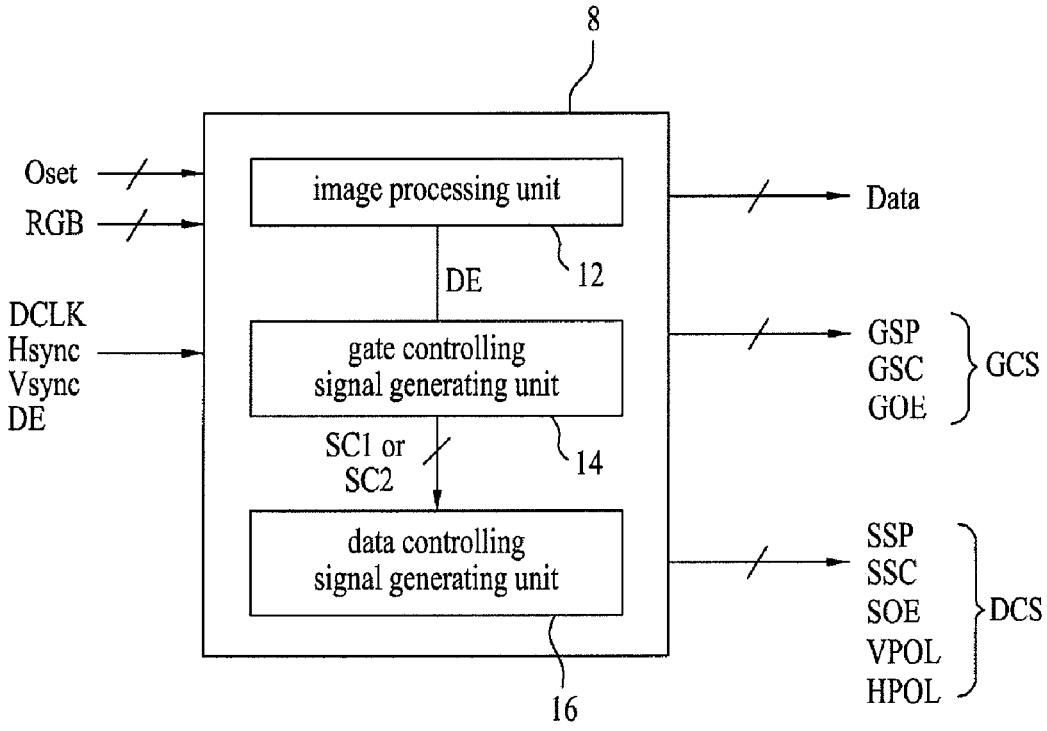
FIG. 2 illustrates a block diagram of the timing controller in FIG. 1 in detail.

FIG. 2 illustrates a block diagram of the timing controller in FIG. 1 in detail.

Referring to FIG. 2, the timing controller 8 includes an image processing unit 12 for arranging the image data R, G, B from an outside of the driver suitable for driving the liquid crystal display panel 2, and supplying the image data R, G, B arranged thus to the data driver 4, and analyzing the image data R, G, B with reference to the pattern recognition information 0*set* to detect defective display pattern or stop detection of the defective display pattern, a gate control signal generating unit 14 for generating the gate control signal GCS by using at least one of the synchronizing signals DCLK, DE, Hsync, and Vsync received from an outside of the driving device, and supplying the gate control signal GCS generated thus to the gate driver 6, and a data control signal generating unit 16 for generating the data control signal DCS by using at least one of the synchronizing signals DCLK, Hsync, Vsync, and DE, and changing and forwarding the horizontal and vertical POL signals HPOL, VPOL of the data control signal DCS according to a result of the detection of the defective display pattern.

The image processing unit 12 arranges the image data R, G, B suitable for driving of the liquid crystal display panel 2 by using at least one of the synchronizing signals DCLK, Hsync, and Vsync, DE, and supplies the image data arranged thus to the data driver 4. In this instance, the image processing unit 12 analyzes the image data R, G, B with reference to the pattern recognition information to detect the defective display pattern, or stop detection of the defective display pattern, and generates and forwards a first or second selection signal SC1 or SC2 depending on a result of diction of the defective display pattern. System and operation of the image processing unit 12 will be described in more detail with reference to the attached drawings.

The gate control signal generating unit 14 generates the GSP and GSC including the GOE by using at least one of the synchronizing signals DCLK, Hsync, Vsync, DE received from the outside, for an example, the data enable signal DE, and the horizontal synchronizing signal Hsync, and supplies the gate control signal GCS generated thus to the gate driver 6. The gate control signal GSC is a signal for controlling timing of the gate driver 6.

The data control signal generating unit 16 generates the SSC, SSP, vertical and horizontal POL signals HPOL, VPOL including the SOE by using at least one of the synchronizing signals DCLK, Hsync, Vsync, DE received from the outside, for an example, the data enable signal DE, and the vertical synchronizing signal Vsync.

In this instance, the data control signal generating unit 16 changes and generates the horizontal and vertical POL signals HPOL, VPOL according to the first or second selection signal SC1 or SC2 from the image processing unit 12, and supplies the data control signal DCS generated thus to the data driver 4. The data control signal DCS is a signal for controlling timing of the data driver 4, and the horizontal and vertical POL signals HPOL, VPOL are signals for changing a polarity of the image signal to be supplied to the data lines DL1~DLm suitable to the first or second inversion driving system.

Figure 3:
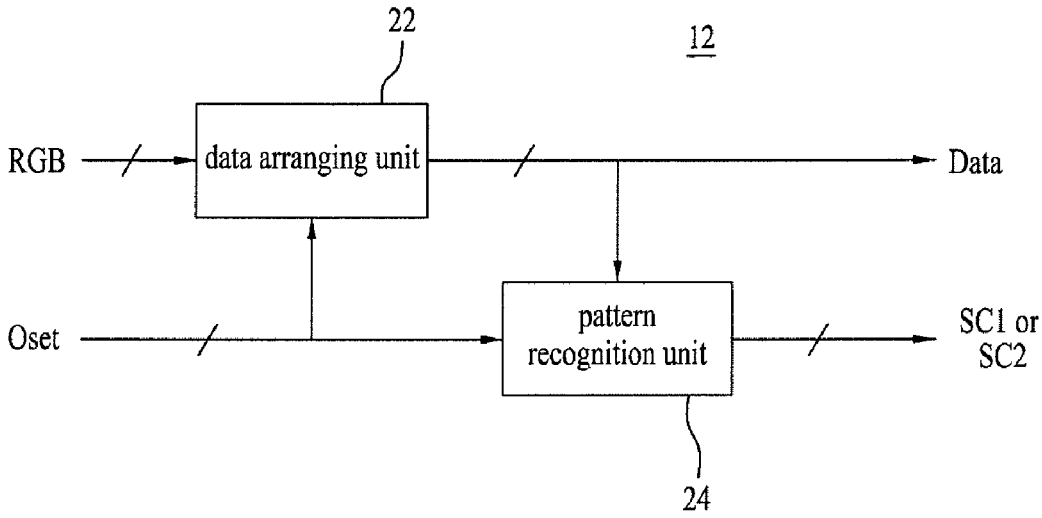
FIG. 3 illustrates a block diagram of the image processor in FIG. 2 in detail.

FIG. 3 illustrates a block diagram of the image processor in FIG. 2 in detail.

Referring to FIG. 3, the image processing unit 12 includes a data arranging unit 22 for receiving, arranging, and forwarding the image data R, G, B suitable to a resolution and a screen size to be displayed on the liquid crystal display panel 2, and a pattern recognition unit 24 for analyzing the image data Data arranged thus to detect the defective display pattern, or stop the detection of the defective display pattern with reference to the pattern recognition information 0*set*, and forwarding the first or second selection signal SC1 or SC2 according to a result of the detection.

The image processing unit 12 receives the image data in a unit of at least one horizontal line together with the at least one synchronizing signal DCLK, Hsync, Vsync, and DE from the outside, arranges the image data R, G, B received thus suitable to a size and resolution of the liquid crystal display panel 2 by using at least one of the synchronizing signal received thus, for an example, the data enable signal DE, and supplies the image data Data arranged thus to the data driver 4 in a horizontal unit in succession.

The pattern recognition unit 24 performs an recognition operation of the defective display pattern from the image data Data arranged thus if the pattern recognition enable signal in the pattern recognition information 0*set* is received, and stops the recognition operation of the defective display pattern if the disable signal is received. As described before, if the recognition operation of the defective display pattern is stopped by the disable signal, the liquid crystal display panel 2 is driven by a preset one inversion system, for an example, the first inversion system.

If the defective display pattern is recognized by the enable signal, the pattern recognition unit 24 makes comparative analysis of the image data Data arranged thus and receiving in succession to the preset defective display pattern one horizontal line by one horizontal line or a frame by a frame. As a result of the analysis, if at least one frame of the image data is identical to the preset defective display pattern at a ratio greater than the detection factor of the defective display pattern, the pattern recognition unit 24 generates the first selection signal SC1 and supplies to the data control signal generating unit 16. Then, the data control signal generating unit 16 generates the horizontal and vertical POL signals HPOL and VPOL in response to the first selection signal SC1 for driving the liquid crystal display panel 2 in the first inversion system and supplies the first selection signal SC1 to the data driver 4.

Then, if the ratio of identity of the at least one frame of the image data with the defective display pattern becomes smaller than the detection stop factor as the result of the comparative analysis of the image data Data arranged thus and receiving in succession to the defective display pattern, the pattern recognition unit 24 generates the second selection control signal SC2, and supplies the second selection control signal SC2 to the data control signal generating unit 16. Then, the data control signal generating unit 16 generates the horizontal and vertical POL signals HPOL and VPOL for driving the liquid crystal display panel 2 in the second inversion system in response to the second selection signal SC2, and supplies the horizontal and vertical POL signals HPOL and VPOL to the data driver 4. Accordingly, it is preferable that the detection stop factor is set at a value, i.e., a ratio, lower than the detection factor. In the meantime, the first inversion system can be at least one of 1×1, 2×1, 1×2, 2×2, and 3×3 dot inversion systems, and the second inversion system can be one of 2×2, 3×3, 4×4, and 5×5 dot inversion systems, which is different from the first inversion system.

Figure 4:
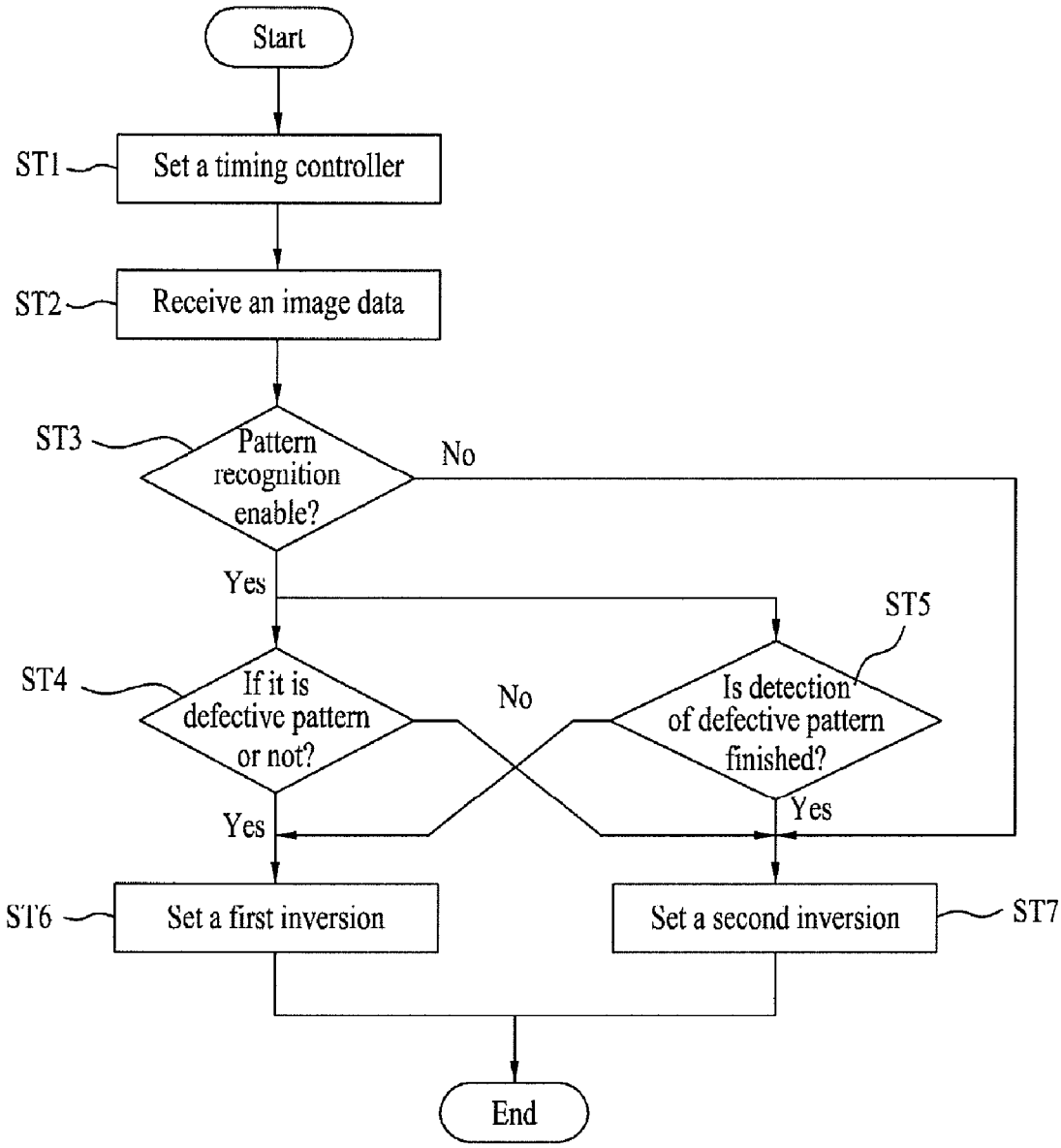
FIG. 4 illustrates a flow chart showing the steps of a method for driving a liquid crystal display device in accordance with a preferred embodiment of the present invention.

FIG. 4 illustrates a flow chart showing the steps of a method for driving a liquid crystal display device in accordance with a preferred embodiment of the present invention. The method for driving a liquid crystal display device in accordance with a preferred embodiment of the present invention will be described step by step with reference to FIGS. 1 to 4.

In the timing controller 8 setting step ST1, pattern recognition information 0*set* from a designer is set and stored at the timing controller 8. A detection factor and a detection stop factor for the defective display pattern in the pattern recognition information 0*set* are preset and stored by the designer, and a pattern recognition enable and a pattern recognition disable signals may be preset by the designer or selectively input by a user.

Then, in the image data input step ST2, if the image data R, G, B are received from an outside system, or the like, in succession, the data arranging unit 22 in the timing controller 8 arranges the image data R, G, B received thus suitable for driving the liquid crystal display panel 2, and supplies to the image data R, G, B arranged thus to the data driver 4.

In the pattern recognition enable determining step ST3, it is determined whether the defective display pattern recognition operation is performed or not with reference to the pattern recognition information 0*set* set thus or the enable signal from the user. That is, if the pattern recognition disable signal is received or set, the defective display pattern recognition operation is performed, and if the pattern recognition enable signal is received or set, the pattern recognition unit 24 performs the defective display pattern recognition operation.

In the defective display pattern recognition step ST4, the image data Data arranged thus and receiving in succession and the preset defective display pattern are comparatively analyzed in at least one horizontal line by one horizontal line or a frame by a frame. If a ratio of identity of the at least one frame of the image data to the preset defective display pattern is greater than the detection factor of the defective display pattern as a result of the analysis, it is determined that a defective picture is to be displayed, a first selection control signal SC1 is generated and supplied to a data control signal generating unit 16.

In the first inversion setting step ST6, the data control signal generating unit 16 generates horizontal and vertical POL signals HPOL, VPOL in response to the first selection signal SC1 from the pattern recognition unit 24 for driving the liquid crystal display panel 2 in the first inversion system, and supplies the first selection signal SC1 to the data driver 4. Then, the data driver 4 changes the image data arranged thus to a positive or negative polarity analog image signal suitable for driving the liquid crystal display panel 2 in the preset first inversion system, and supplies the analog image signal to the data lines DL1~DLm.

In the meantime, in the defective display pattern detection stopping step ST5, if the ratio of the identity of the at least one frame of the image data to the defective display pattern becomes smaller than the detection stop factor as the result of the comparative analysis of the image data Data arranged thus and receiving in succession and the defective display pattern, the forwarding of the first selection control signal SC1 is stopped. Then, a second selection control signal SC2 is forwarded, i.e., supplied to the data control signal generating unit 16.

In the second inversion setting step ST7, the data control signal generating unit 16 generates the horizontal and vertical POL signals HPOL, VPOL in response to the second selection signal SC2 from the pattern recognition unit 24 for driving the liquid crystal display panel 2 in the second inversion system, and supplies the horizontal and vertical POL signals HPOL, VPOL to the data driver 4. Then, the data driver 4 changes the image data arranged thus to a positive or negative polarity analog image signal suitable for driving the liquid crystal display panel 2 in the preset second inversion system, and supplies the analog image signal to the data lines DL1~DLm.

As has been described, the device and method for driving a liquid crystal display device of the present invention have the following advantages.

The setting of the detection factor of the defective display pattern and the detection stop factor of the defective display pattern permits to control a detection time point and a detection stop time point of the defective display pattern suitable to cases.

Moreover, the reduction of influence caused by variation of brightness of the image coming from a difference between the detection factor and the detection stop factor of the defective display pattern permits to change the inversion system without being influenced by the frequent screen brightness change.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A device for driving a liquid crystal display device, comprising:

a liquid crystal display panel having a plurality of pixel regions;

a gate driver for driving a plurality of gate lines on the liquid crystal display panel;

a data driver for driving a plurality of data lines on the liquid crystal display panel; and a timing controller for analyzing an image data received from an outside of the timing controller according to pattern recognition information having a detection factor and a detection stop factor for a defective display pattern to detect, or stopping detection of, the defective display pattern, and changing an inversion system of the liquid crystal display panel according to a result of the detection of the defective display pattern.

2. The device as claimed in claim 1, wherein the pattern recognition information includes the detection factor and detection stop factor for the defective display pattern, an enable signal and disable signal, and wherein the enable signal is a signal for making the timing controller to perform a defective display pattern recognition operation, and the disable signal is a signal for making the timing controller to stop the defective display pattern recognition operation, the defective display pattern detection factor is a value for representing a ratio of identity of at least one frame of the image data to a preset defective display pattern, and the defective display pattern detection stop factor is a value for representing a ratio of identity of the at least one frame of the image data to the preset defective display pattern, which is set at a value lower than the detection factor.

3. The device as claimed in claim 2, wherein the timing controller includes:

an image processing unit for arranging the image data suitable for driving the liquid crystal display panel, supplying the image data to the data driver, and analyzing the image data with reference to the pattern recognition information to detect defective display pattern or stop detection of the defective display pattern, a gate control signal generating unit for generating the gate control signal by using at least one of the synchronizing signals received from an outside of the driving device, and supplying the gate control signal to the gate driver, and a data control signal generating unit for generating the data control signal by using at least one of the synchronizing signals, and changing and forwarding the horizontal and vertical POL signals of the data control signal according to a result of the detection of the defective display pattern.

4. The device as claimed in claim 3, wherein the image processing unit includes:

a data arranging unit for arranging, and forwarding the image data suitable to a resolution and a screen size to be displayed on the liquid crystal display panel, and a pattern recognition unit for analyzing the image data to detect the defective display pattern, or stop the detection of the defective display pattern with reference to the pattern recognition information, and forwarding a first or second selection signal according to a result of the detection.

5. The device as claimed in claim 4, wherein the pattern recognition unit makes comparative analysis of the image data arranged thus to the preset defective display pattern in response to the enable signal, and, if an identity ratio of at least one frame of the image data to the preset defective display pattern is greater than the detection factor of the defective display pattern as a result of the analysis, generates the first selection signal for changing the inversion system, and supplies to the data control signal generating unit, and if the identity ratio of the at least one frame of the image data to the defective display pattern becomes smaller than the detection stop factor as the result of the comparative analysis of the image data arranged thus to the defective display pattern, the pattern recognition unit generates the second selection control signal for changing the inversion system, and supplies the second selection control signal to the data control signal generating unit.

6. A method for driving a liquid crystal display device, comprising the steps of:

setting pattern recognition information having a defection factor and a detection stop factor of a defective display pattern at a timing controller;

analyzing an image data receiving from an outside with reference to the pattern recognition information for detecting the defective display pattern, or stopping detection of the defective display pattern; and changing or maintaining an inversion system of the liquid crystal display panel depending on a result of detection of the defective display pattern by using the pattern recognition information.

7. The method as claimed in claim 6, wherein the pattern recognition information includes the detection factor for the defective display pattern, the detection stop factor, an enable signal, and an disable signal, the enable signal is a signal for making the timing control to perform a defective display pattern recognition operation, and the disable signal is a signal for making the timing control to stop the defective display pattern recognition operation, the defective display pattern detection factor is a value representing an identity ratio of at least one frame of the image data to the preset defective display pattern, and though the detection stop factor is a value representing an identity ratio of at least one frame of the image data to the preset defective display pattern, the detection stop factor is set at a value lower than the detection factor.

8. The method as claimed in claim 7, wherein the step of analyzing an image data includes the steps of:

arranging the image data suitable to a resolution and a screen size of the liquid crystal display panel, and supplying the image data arranged thus to a data driver, and comparing the image data arranged thus to the defective display pattern in at least frame by frame upon reception of the enable signal, and stopping the comparison of the image data arranged thus to the defective display pattern upon reception of the disable signal.

9. The method as claimed in claim 8, wherein the step of changing or maintaining an inversion system of the liquid crystal display panel includes the steps of:

comparing a result of the comparison of the defective display pattern to the image data arranged thus to the detection factor of the defective display pattern or the detection stop factor, and forwarding the first or second selection signal depending on a result of the comparison, and changing a POL signal of the data control signal in correspondence to the first or second selection signal, and supplying the POL signal changed thus to the data driver.

10. The method as claimed in claim 9, wherein the step of forwarding the first or second selection signal includes the steps of:

generating and forwarding the first selection control signal for changing the inversion system, if the identity ratio of at least one frame of image data to the preset defective display pattern is greater than the defective display pattern detection factor as a result of the comparison of the image data arranged thus to the preset defective display pattern, and generating and forwarding the second selection control signal for changing the inversion system, if the identity ratio of at least one frame of image data to the preset defective display pattern is smaller than the defective display pattern detection stop factor as a result of the comparison of the image data arranged thus to the preset defective display pattern.

* * * * *